US006357141B1

(12) United States Patent
Kearsley et al.

(10) Patent No.: US 6,357,141 B1
(45) Date of Patent: Mar. 19, 2002

(54) EVAPORATOR WITH HOT AIR BATH AND METHOD OF USE

(75) Inventors: Paul A. Kearsley, Hopedale; Tye Fowler, Uxbridge; Barry T. Hixon, Upton, all of MA (US)

(73) Assignee: Zymark Corporation, Hopkinton, MA (US)

( * ) Notice: Subject to any disclaimer, the term of this patent is extended or adjusted under 35 U.S.C. 154(b) by 0 days.

(21) Appl. No.: 09/524,668

(22) Filed: Mar. 13, 2000

(51) Int. Cl.[7] ..... F26B 5/06

(52) U.S. Cl. ..... 34/305; 34/516; 34/72; 34/202; 34/204; 34/215; 34/222; 34/232; 422/101; 422/124

(58) Field of Search ..... 34/302, 305, 418, 34/423, 516, 72, 84, 202, 204, 215, 222, 232; 422/100, 101, 102, 124

(56) References Cited

U.S. PATENT DOCUMENTS

| | | | | |
|---|---|---|---|---|
| 5,176,799 A | * | 1/1993 | Roe et al. | 202/185.3 |
| 5,681,492 A | | 10/1997 | VanPraet | |
| 5,897,838 A | | 4/1999 | Kempe | |
| 5,908,776 A | | 6/1999 | Burbaum et al. | |
| 5,937,536 A | | 8/1999 | Kieselbach et al. | |
| 6,146,595 A | * | 11/2000 | Mikulsky | 422/101 |
| 6,264,895 B1 | * | 7/2001 | Johnson | 422/101 |

* cited by examiner

*Primary Examiner*—Pamela Wilson
(74) *Attorney, Agent, or Firm*—John E. Toupal; Harold G. Jarcho

(57) ABSTRACT

An evaporating system for evaporating solvents from chemical samples held in supply plates, which accelerate evaporation by warming the samples in a hot air bath. The system includes adapters to allow the use of supply plates of varying heights, such as either standard micro-plates or deep well micro-plates.

22 Claims, 9 Drawing Sheets

EVAPORATOR WITH HOT AIR BATH AND METHOD OF USE

FIELD OF THE INVENTION

The present invention is related generally to evaporating systems for evaporating liquid from chemical samples and, more particularly, to evaporating systems which are capable of rapidly evaporating liquid from chemical samples held in supply plates of varying heights, such as either standard micro-plates or deep well micro-plates.

BACKGROUND OF THE INVENTION

It is often desirable to transfer a chemical sample from one solvent to another. For example, in liquid chromatography, a sample, perhaps a liquid fraction obtained from one chromatographic procedure, can be more specifically analyzed by use of a different solvent. Further, to reduce spills and the likelihood of cross-contamination and to prevent degradation, due for example to oxidation, samples are often placed within wells and dried by evaporating the solvents in which they are dissolved. It is common to place the well holding the dissolved sample into a heated bath and contact the sample with sufficient inert drying gas to evaporate the unwanted solvent.

Previous evaporation systems have used hot water baths, (heated gas), or mass-to-mass heat conduction to maintain higher sample temperatures during evaporation. These systems were primarily adapted to evaporate samples in individual test tubes and glassware.

Lately, laboratories have been reducing the volumes of expensive solvents used to dissolve samples. Not only are the solvents expensive, but safety and environmental concerns make excessive use of such solvents undesirable. Accordingly, more and more laboratories are switching from test tubes and glassware to micro-plates and deep well micro-plates which have significantly lower volume than test tubes and glassware. Also, such plates are standard in size, stackable, less cumbersome and make handling and storage much easier.

Plates such as these are available in a variety of standard sizes, including the most common ninety-six well plate, available in either shallow (standard) or deep (deep-well) configurations. Although the footprint of both a standard and a deep-well plate are identical for a given number of arrays, plate heights differ substantially. Standard micro-plates are approximately 12 mm high while deep-well plates are approximately 39 mm high. It is also anticipated that wells of various other heights will be introduced as technology develops and needs change.

The process of evaporating solvents from samples can be quite expensive. Drying gas, lab and equipment times, and heating energy are some of the expenses which require consideration and make evaporation efficiency of special concern. In order to evaporate a solvent from a sample most efficiently, it is critical to precisely control the positioning of the sample relative to the drying gas flow, to control the exposure of the sample to the drying gas, and to optimize the warming of the sample by the bath.

Previous evaporation systems have not been well adapted to drying well plates of various heights. As a result, drying gas is positioned to properly contact only one type of plate, or the flow path of the gas is compromised to allow the non-optimized drying of various plates. In U.S. Pat. No. 5,937,536, Kieselbach describes a system intended to dry both standard and deep-well plates by physically accepting either and exposing each to a nitrogen gas flow from a high or a low manifold. In order to accommodate the deep-well plates however, the manifolds must be positioned far aside from or above the plate positions, reducing the efficiency of evaporation from either type of plate by not allowing the gas to be injected directly from the manifold to the sample.

Previous systems have also been only marginally effective at removing the vaporized solvents that tend to gather over the samples as they evaporate. By forming a cloud of solvent vapor immediately above the surface of the dissolved chemical sample, the evaporated solvents reduce the vapor pressure differential at the surface and reduce the rate at which the solvents further evaporate. Effective removal of the vapor is critical to efficient evaporation. Systems such as Kieselbach's, wherein the flows of inert gas and exhaust gas are remote from the surface of the sample are particularly inefficient at evaporating the solvents and removing the vapor that is formed.

Previous systems have also suffered by lacking an effective method of heating the samples. Mass-to-mass heat conduction has proven inefficient and prone to heating the samples unevenly. Hot water baths leave the plates wet after evaporation. Since plates are stackable and often carried and stored atop one-another, cross-contamination is a problem with samples coming out of a hot water system. Also, multi-well plates which are most commonly used nowadays have a closed upper surface which forms an air trap and does not allow hot water to rise around and envelop the wells, making hot water baths very inefficient at warming such plates. Hot air has proven to be the most effective in drying samples, but the introduction of air can counter the effects of the inert drying gas. In systems where the drying gas is not injected directly into the sample, and the warming air is not isolated from the drying gas, such as Kieselbach, the drying gas would be prone to mixture with the air and could thereby become diluted and contaminate the sample.

Further, previous systems do not allow for the independent evaporation control of multiple plates. Systems such as Kieselbach subject all plates to the same conditions. A deep-well plate holding one type of sample and a standard plate holding another type of sample can certainly be placed into Kieselbach's chamber, but individual and independent control of the evaporation parameters to each plate is impossible.

A system is therefore desirable, but so far unavailable, which can accept and effectively dry samples in plates of many various heights without compromise, and which can effectively subject the samples to a warming bath of hot air while not diluting or damaging the beneficial effects of the inert drying gas before it contacts the sample.

The object of the present invention, therefore, is to provide a system for evaporating dissolved chemical samples which is adaptable to sample plates of a variety of heights.

It is a further object of the invention to provide such a system, which efficiently exposes samples of all heights to the most effective flow of drying gas.

It is a further object of the invention to provide such a system, which most effectively warms samples of all heights to accelerate evaporation by subjecting them to a bath of warm air.

It is a further object of the invention to provide such a system in which the warm air does not decrease the effectiveness of the drying gas by diluting it before it contacts the sample.

It is a further object of the invention to provide a more effective means for heating the individual wells in a supply plate by a hot air bath.

It is a further object of the invention to provide a more effective means for removing the solvent vapors from above the samples.

It is a further object of the invention to control simultaneous flow of inert gas to multiple plates independently.

It is a further object of the invention to control simultaneous flow and temperature of warming air to multiple plates independently.

SUMMARY OF THE INVENTION

The present invention is an apparatus for evaporating solvents from chemical samples, which includes one or more of a series of adapters that each mate to a supply plate of a different height to thereby position the top surface of the plate at a level which is consistent from plate to plate. Inert gas is injected into the upper surface of each sample, and since that upper surface is always at the same level, regardless of the plate height, the relationship of the inert gas injectors and the supply wells is consistent, regardless of the plate height.

Further, the adapters are hollow to allow fan-forced hot air from underneath the plate to bathe each well individually by evenly enveloping the outer wall of each well. This accelerates the evaporation most efficiently while avoiding mixture with and dilution of the inert drying gas that contacts the samples.

Still further, a parallel flow of fan forced air entrains the inert gas/solvent vapor mixture after that mixture evaporates from the sample and carries it from the sample and exhausts it from the apparatus where it can be fed into a fume hood or an exhaust vent. This removal of the vapors immediately above the sample further accelerates the drying process.

The apparatus is contained in a compact and efficient package which allows the user to load and unload two individual supply plates efficiently, and without any disassembly of the apparatus. Further, two plates of differing height can be evaporated simultaneously. It is further provided that the inert gas flow and the hot air flow to each of the two plates may be individually controlled in the event that a different drying process is desired for each plate.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
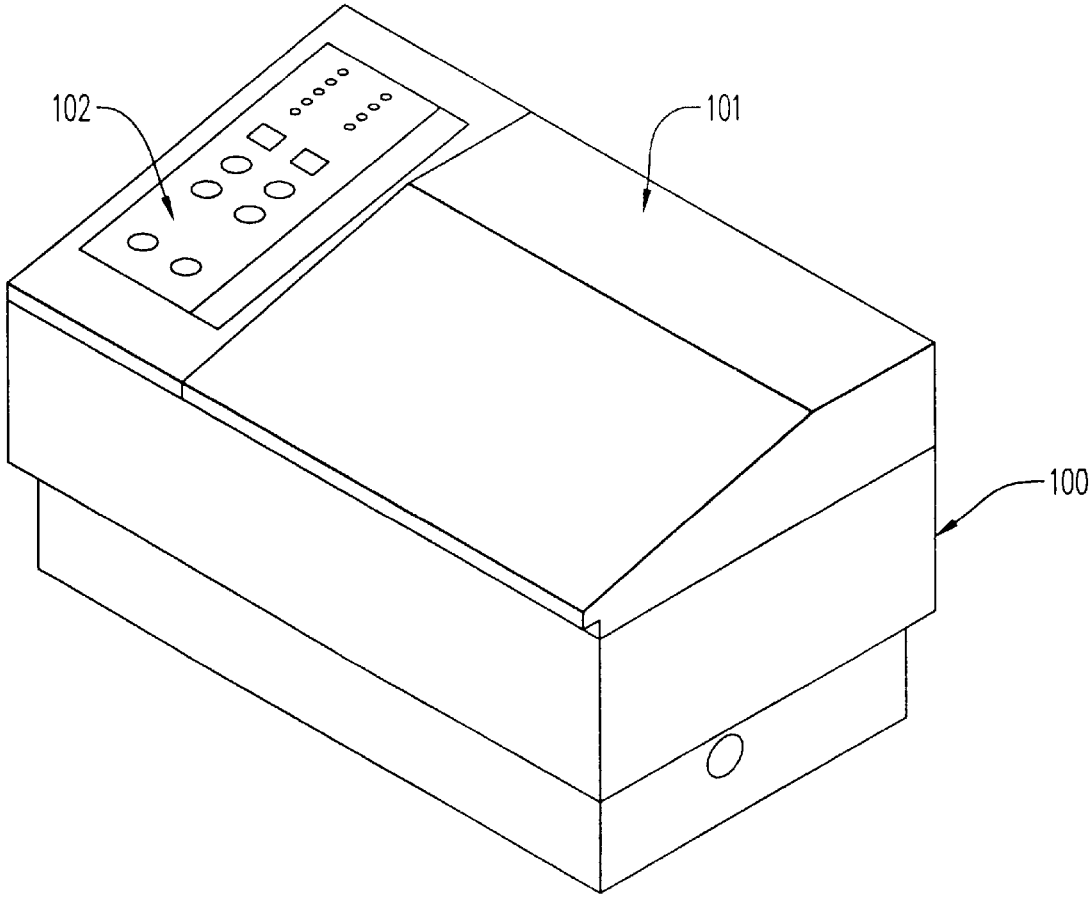
FIG. 1 is a perspective view of the preferred embodiment of the invention.
Figure 2:
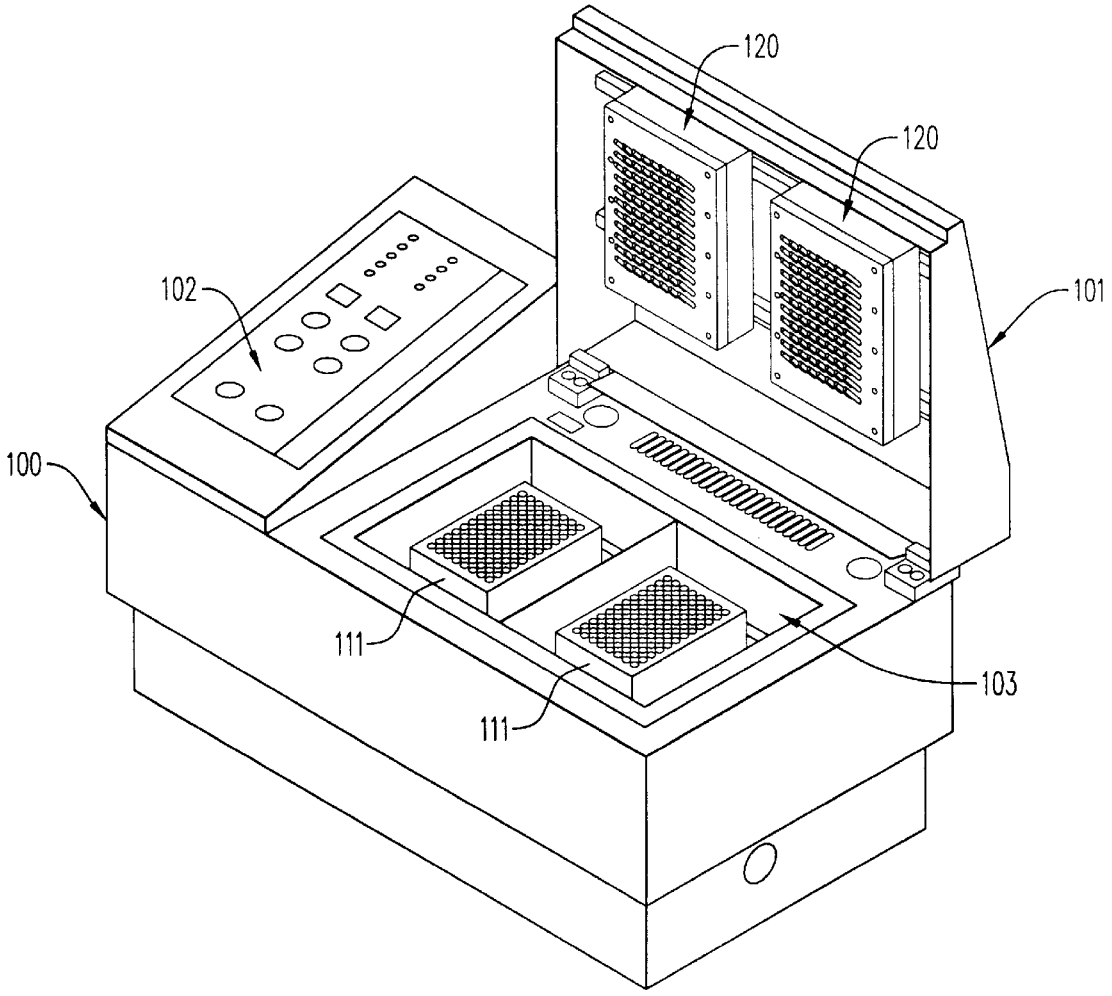
FIG. 2 is a perspective view of the preferred embodiment with the cover open and supply plates in position for evaporation.
Figure 3:
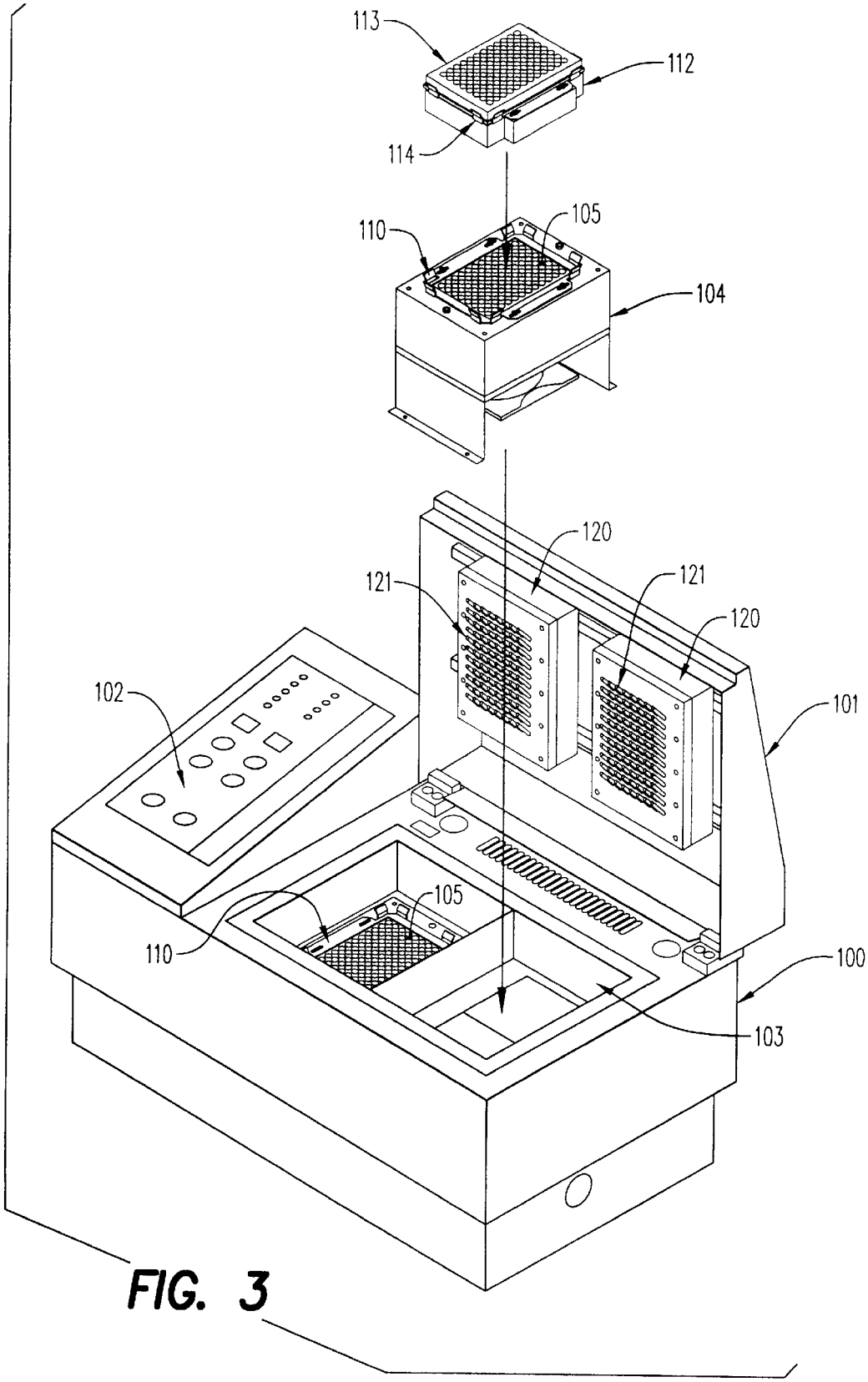
FIG. 3 is a perspective view of the preferred embodiment showing one of the heat/plenum assemblies and a standard micro-plate and its adapter exploded therefrom.
Figure 4A:
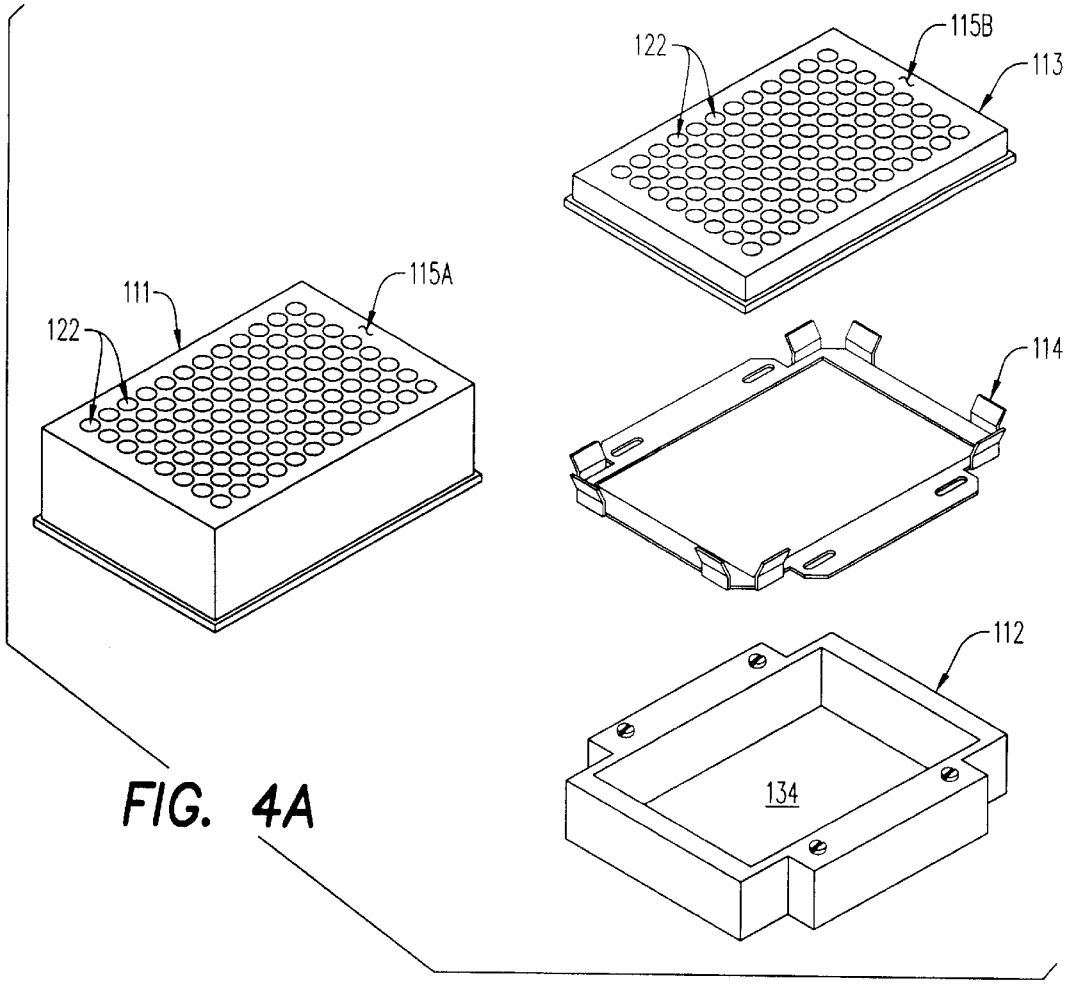
FIG. 4A is a comparative set of exploded perspective views showing a standard micro-plate and its adapter beside a deep-well plate.
Figure 4B:
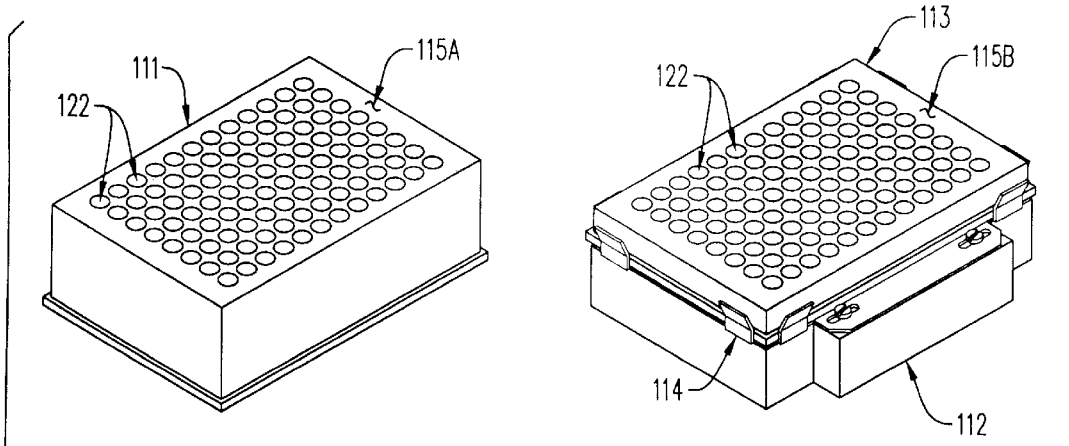
FIG. 4B is a comparative set of perspective assembly views showing a standard micro-plate and its adapter beside a deep-well plate.
Figure 5:
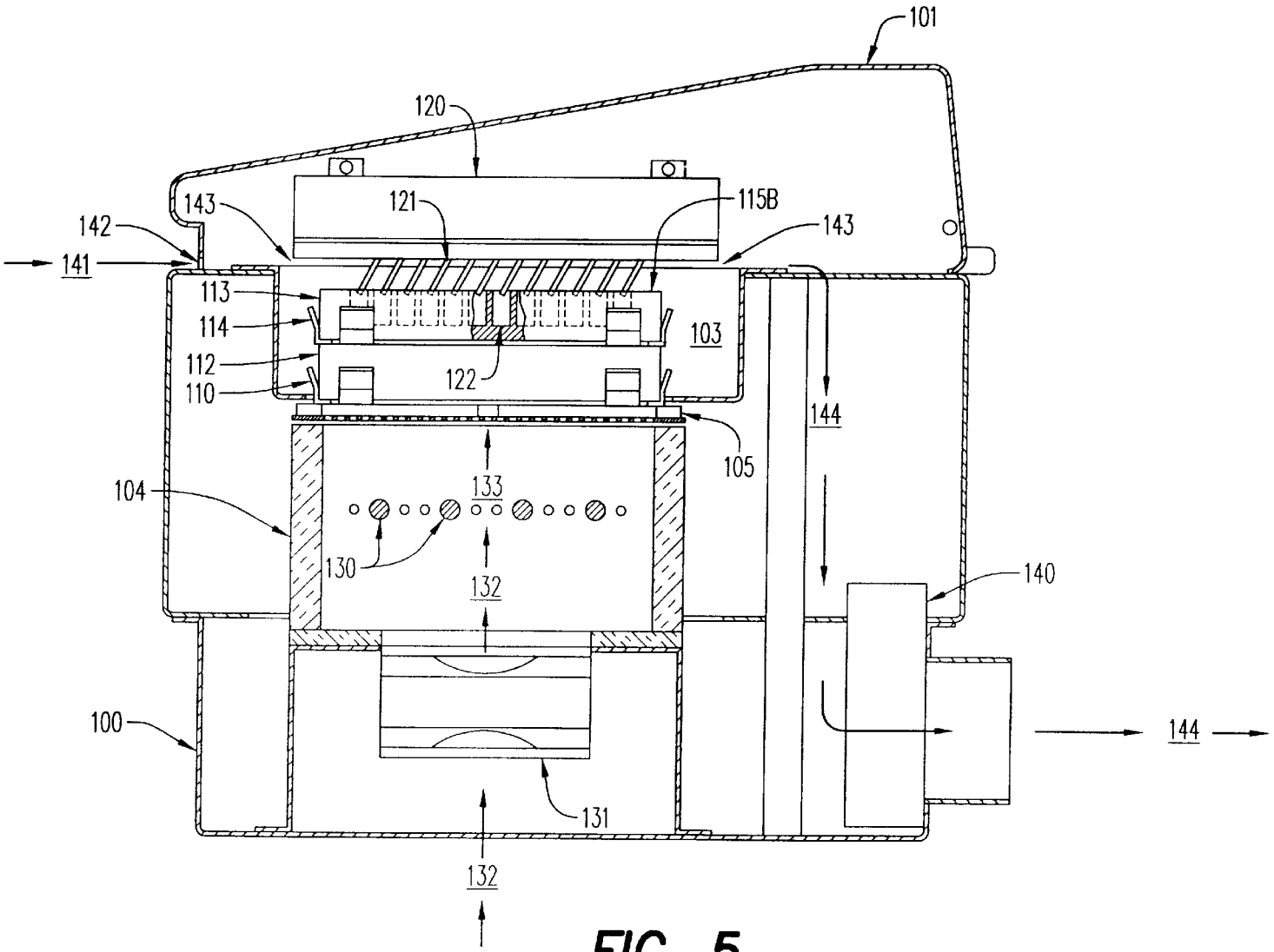
FIG. 5 is a cross sectional view of the preferred embodiment including a standard micro-plate, showing the inert gas and hot-air flows during evaporation.
Figure 6:
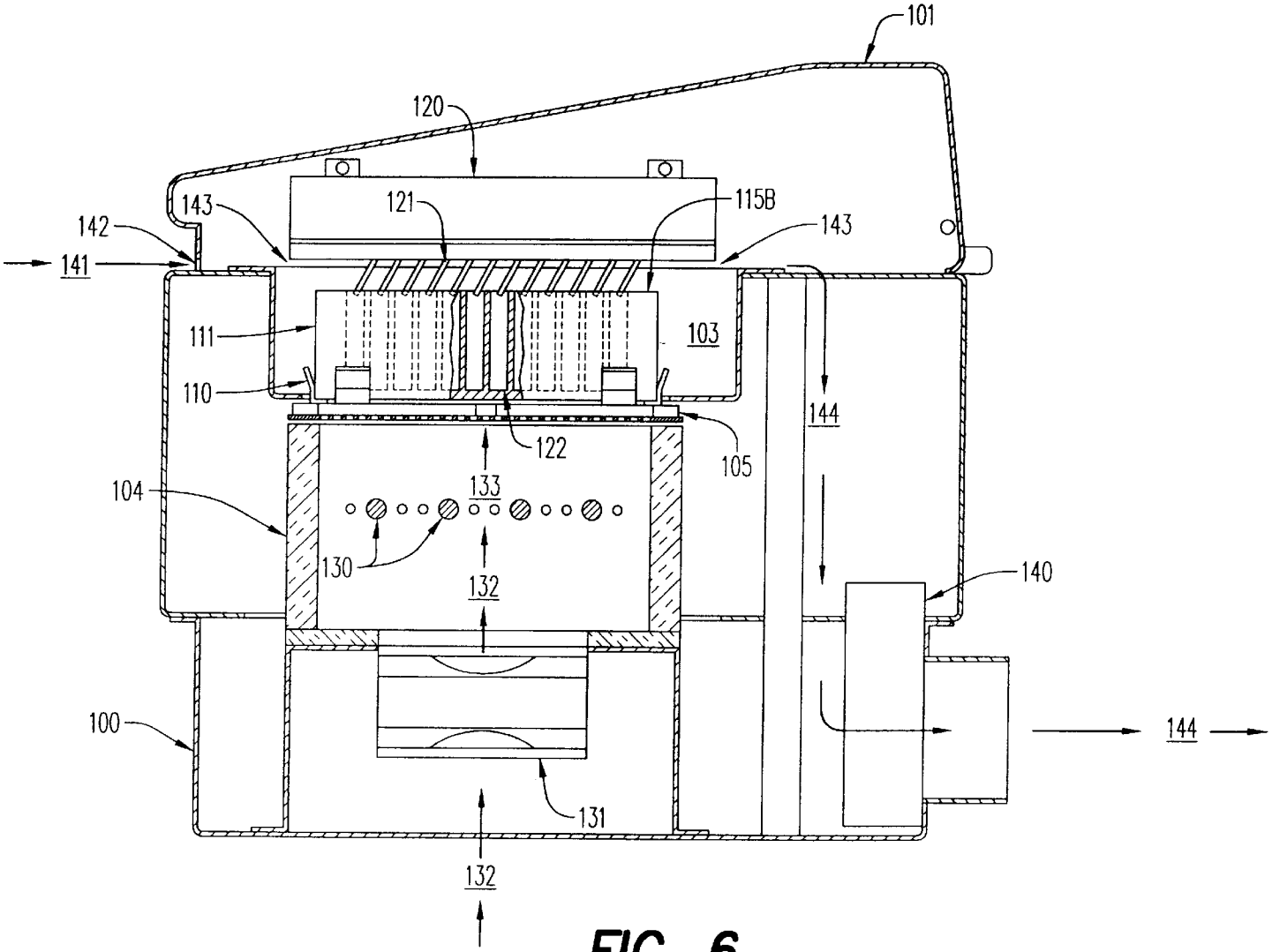
FIG. 6 is a cross sectional view of the preferred embodiment including a deep-well micro-plate, showing the inert gas and hot-air flows during evaporation.
Figure 7:
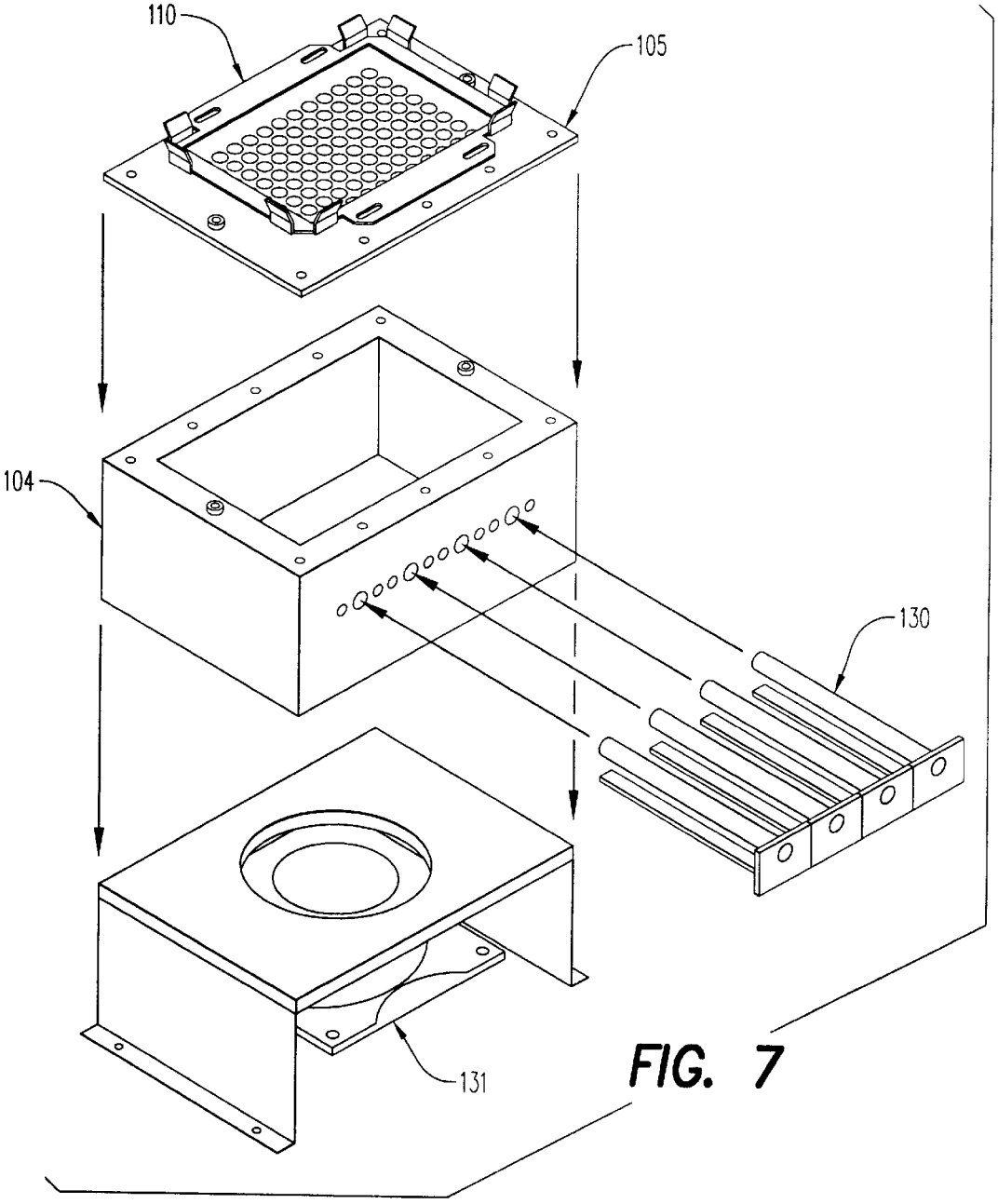
FIG. 7 is an exploded view of a plenum assembly.

Referring to FIGS. 1 through 6, the preferred embodiment of the invention comprises a main housing 100 and a hinged cover 101. On the forward surface of the housing is a control panel 102, which allows the user to readily control all of the variables of evaporation. Within the housing and under the cover is an evaporation chamber 103, which includes twin plena 104 covered by perforated vent covers 105. Locators 110 for accepting either a 96-well deep-well plate 111 or an adapter 112 for a standard 96-well micro-plate 113 are affixed to the vent covers. The standard plate adapter is identical in peripheral footprint to the plate itself, so that it fits into the locator in the same manner as the deep-well plate does. Affixed to the top surface of the adapter is an additional locator 114, identical to the lower locators, for accepting the standard micro-plate. The combined height of the adapter and its locator is 27 mm to account for the fact that the deep-well plate is 27 mm taller than the standard plate. When the standard plate is positioned atop the adapter, its combined height is identical to the height of a deep-well plate; 37 mm. This ensures that when properly arranged and in place, the upper surfaces 115A and 115B of both plates are at the same level, as is best seen in FIGS. 5 and 6.

Attached to the underside of the hinged cover are twin gas manifolds 120, which are connected to a gas supply (not shown). Each manifold includes an array of 96 exhaust nozzles 121, which is arranged identically to the array configuration in the plates. As best seen in FIGS. 5 and 6, when the cover is properly closed for operation, these exhaust nozzles are inserted into the individual well cavities 122 of the plates so that gas 123 from the nozzles immediately impinges the sample 124 in the well before it can be contaminated or diluted. This provides the most effective exposure for the sample. After impinging the sample, the nitrogen and evaporating solvents from the sample rise above the sample in the form of a gaseous nitrogen/solvent mixture 125. Unless rapidly removed, this mixture would retard further evaporation by reducing the vapor pressure differential of the solvent across the liquid surface.

Located within each plenum is a hot air system, which includes multiple electric heating elements 130 and a fan 131. The constant fan speed and heat wattage are adjustable by the user at the control panel and can be independently controlled to provide differing effects to each plate. This is an advantageous feature of the invention.

As shown in FIGS. 5 and 6, incoming air 132 is drawn into the apparatus by the fan and passed over the heating element where it is warmed to a pre-selected temperature. This warmed air 133 flows upward through the plenum, passes through the hollow opening 134 of the adapter when the standard micro-plate assembly is being used, and envelops each of the thin outer walls 135 of the supply wells. With exhaust hot air vented only transversely of the plenum, the airflow becomes turbulent between the top of the plenum and the plate, further increasing the transfer of heat to the plate. This method of heating is found to most evenly warm the samples and therefore most efficiently assist the evaporation of solvents therefrom.

Figure 9:
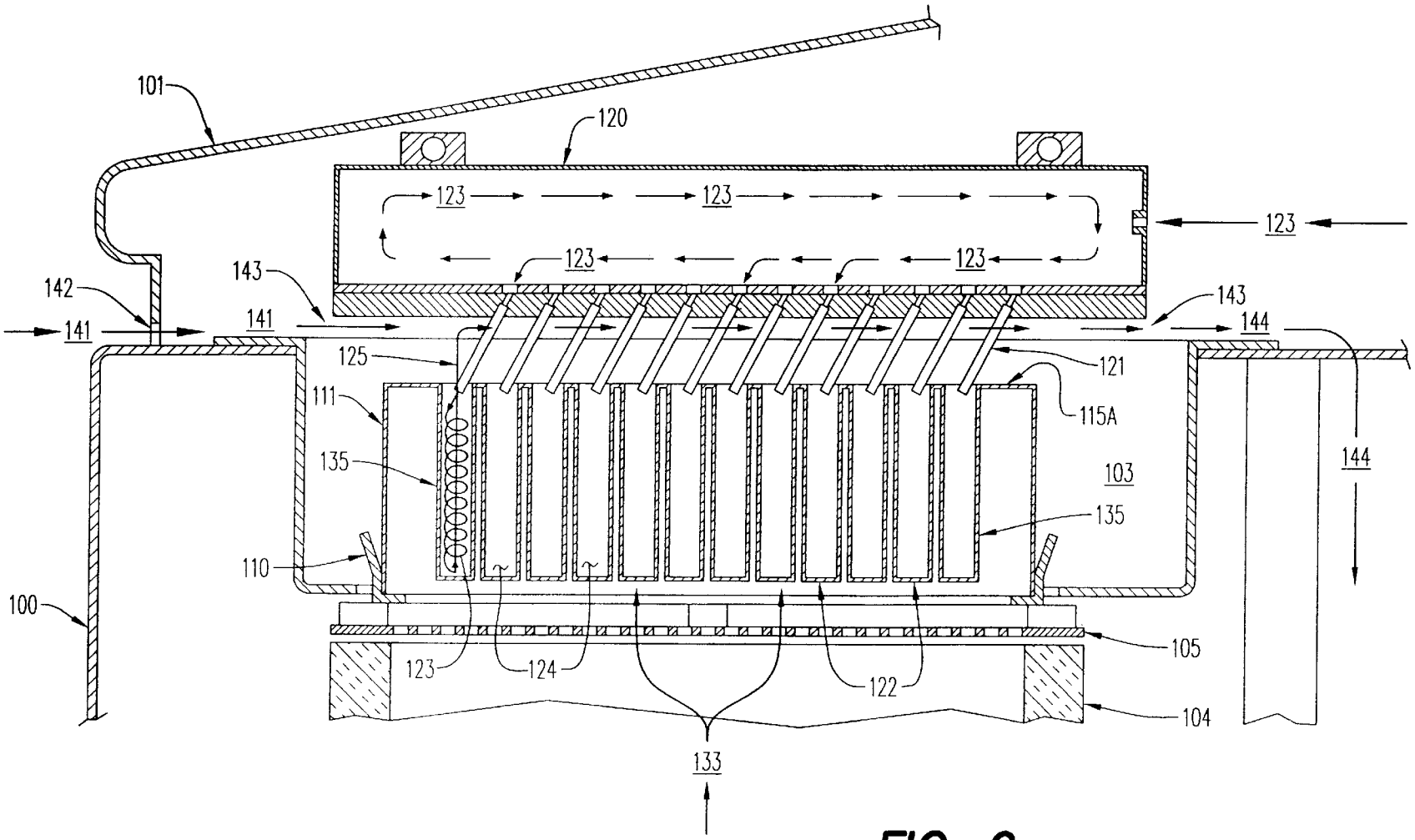
FIG. 9 is a cross sectional view through one of the inert gas manifolds of the preferred embodiment showing the flow of inert gas to the supply wells and the flow of exhaust gas.

Meanwhile, referring to FIGS. 5, 6,and 9, exhaust fan 140 pulls ambient air 141 into the evaporation chamber through intake slot 142 in the front of the cover. This air passes through the narrow gap 143 between the cover and the upper surfaces of the plates, where it mixes with and entrains the gaseous nitrogen/solvent mixture rising from the samples. This combined flow 144, comprising the nitrogen/solvent mixture and the ambient air, is pulled by the exhaust fan out of the apparatus where it can be removed by a fume hood or exhaust vent (not shown).

Figure 8:
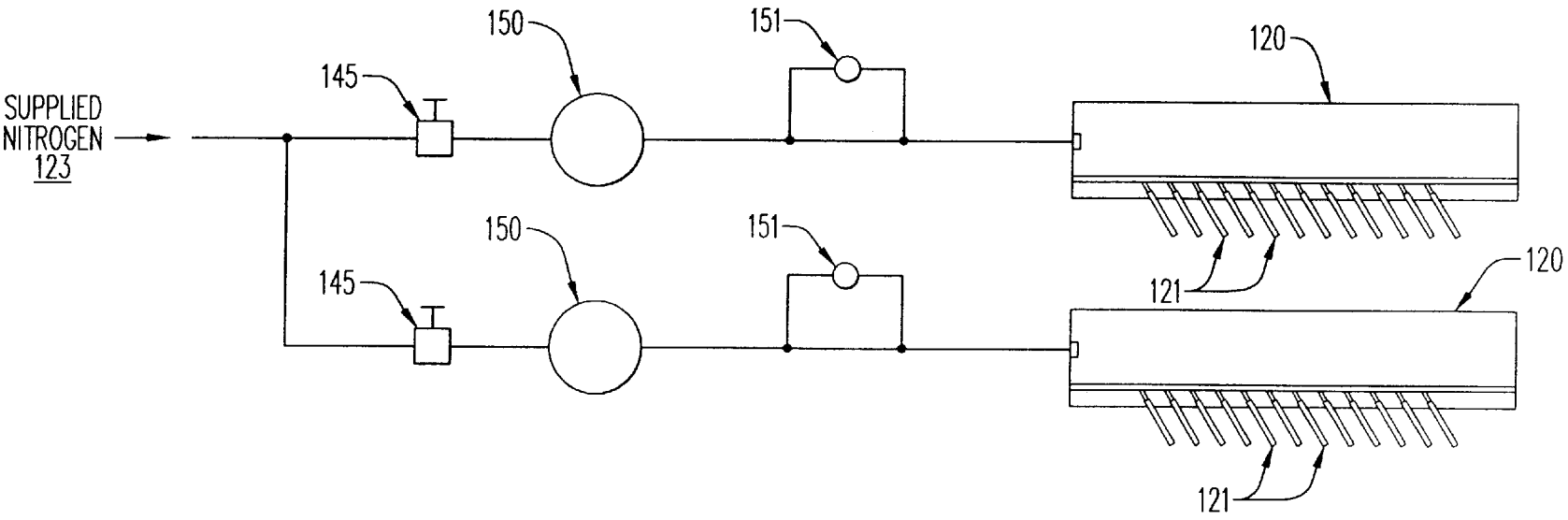
FIG. 8 is a schematic diagram of the inert gas supply system for the apparatus of the preferred embodiment.

A diagram of the nitrogen gas system is provided in FIG. 8. Each of the two manifolds is independently fed from the nitrogen supply through regulators 145 and valves 150. Flow sensors 151 sense the flow of nitrogen to each manifold independently so that each manifold can be controlled independently by the user. This is an advantageous feature of the present invention.

It should be understood that the invention is not to be limited by the above embodiment, which is merely a representative example of many possible embodiments. Thus, the scope of the invention should only be limited by the following claims.

What is claimed is:

1. An apparatus for evaporating solvents from chemical samples held in standard supply plates, said supply plates of the type having a horizontal upper surface, a multitude of supply wells therein, and an underside, said apparatus comprising:

a drying chamber for directing an inert drying gas at said chemical samples and comprising;

a first locator adapted for rigidly holding a first of said plates such that said horizontal upper surface of said first plate is vertically positioned at a desired level;

a first inert gas injecting manifold having a multitude of injection nozzles equal to said multitude of supply wells, wherein said multitude of nozzles is positionable approximately at said desired level, and at said multitude of supply wells in said first plate, one nozzle per corresponding well, and each of said nozzles is adapted to inject said inert drying gas into said corresponding well and at said corresponding chemical sample therein, whereby said drying gas evaporates said solvents from said corresponding chemical sample to form an inert gas and solvent gas mixture;

an exhauster for removing said inert gas and solvent gas mixture from said apparatus; and a warming chamber, atmospherically isolated for said drying chamber, and adapted to bathe said underside of said supply plates in hot air to accelerate said evaporation.

2. An apparatus according to claim 1 wherein said warming chamber includes a heater and a blower.

3. An apparatus according to claim 2 wherein said heater is adapted to provide a variable heat output.

4. An apparatus according to claim 2 wherein said blower is adapted to provide air flow.

5. An apparatus according to claim 4 wherein said heater is adapted to provide a variable heat output.

6. An apparatus according to claim 1 wherein said first inert gas injecting manifold is adapted to provide a variable inert gas flow.

7. An apparatus according to claim 6 wherein said warming chamber comprises a heater and a blower.

8. An apparatus according to claim 7 wherein said heater is adapted to provide a variable heat output.

9. An apparatus according to claim 7 wherein said blower is adapted to provide air flow.

10. An apparatus according to claim 9 wherein said heater is adapted to provide a variable heat output.

11. An apparatus according to claim 1 wherein said locator further comprises a removable adapter for rigidly holding said first of said plates such that said horizontal upper surface of said first plate is vertically positioned at said desired level.

12. An apparatus for evaporating solvents from chemical samples held in standard supply plates, said supply plates of the type having a horizontal upper surface, a multitude of supply wells therein, and an underside, said apparatus comprising:

a drying chamber for directing an inert drying gas at said chemical supplies and comprising;

a first locator adapted for rigidly holding a first of said plates such that said horizontal upper surface of said first plate is vertically positioned at a desired level;

a second locator adapted for rigidly holding a second of said plates such that said horizontal upper surface of said second plate is vertically positioned at said desired level;

a first inert gas injecting manifold having a multitude of injection nozzles equal to said multitude of supply wells, wherein said multitude of nozzles is positionable approximately at said desired level, and at said multitude of supply wells in said first plate, one nozzle per corresponding well, and each of said nozzles is adapted to inject said inert drying gas at said corresponding chemical sample, whereby said drying gas evaporates said solvents from said corresponding sample to form an inert gas and solvent gas mixture;

a second inert gas injecting manifold having a second multitude of injection nozzles equal to said multitude of supply wells, wherein said second multitude of nozzles is positionable at said desired level or below, and into said multitude of supply wells in said second plate, one nozzle per well, and each of said nozzles is adapted to inject said inert drying gas into said corresponding well and at said corresponding chemical sample therein, whereby said drying gas evaporates said solvents from said corresponding chemical sample to form an inert gas and solvent gas mixture;

an exhauster for removing said inert gas and solvent gas mixture from said apparatus; and a warming chamber, atmospherically isolated for said drying chamber, and adapted to bathe said underside of said supply plates in hot air to accelerate said evaporation.

13. An apparatus according to claim 12 wherein said warming chamber comprises a heater and a blower.

14. An apparatus according to claim 13 wherein said heater is adapted to provide a variable heat output.

15. An apparatus according to claim 13 wherein said blower is adapted to provide air flow.

16. An apparatus according to claim 15 wherein said heater is adapted to provide a variable heat output.

17. An apparatus according to claim 12 wherein said first and second inert gas injecting manifolds are adapted to provide independent variable inert gas flows.

18. An apparatus according to claim 17 wherein said warming chamber includes a heater and a blower.

19. An apparatus according to claim 18 wherein said heater is adapted to provide a variable heat output.

20. An apparatus according to claim 18 wherein said blower is adapted to provide air flow.

21. An apparatus according to claim 20 wherein said heater is adapted to provide a variable heat output.

22. An apparatus according to claim 12 wherein at least one of said locators further comprises a removable adapter for rigidly holding said plate such that said horizontal upper surface of said plate is vertically positioned at said desired level.

* * * * *